US008186088B2

(12) United States Patent
Victor et al.

(10) Patent No.: US 8,186,088 B2
(45) **Date of Patent: *May 29, 2012**

(54) SECURING SYSTEM WITH HOUSING FOR HARDWARE

(75) Inventors: Hugh Victor, Huntington Woods, MI (US); Steven Lawrence Carolin, Lake Orion, MI (US)

(73) Assignee: Hugh Victor, Huntington Woods, MI (US)

( * ) Notice: Subject to any disclaimer, the term of this patent is extended or adjusted under 35 U.S.C. 154(b) by 48 days.

This patent is subject to a terminal disclaimer.

(21) Appl. No.: 12/537,590

(22) Filed: Aug. 7, 2009

(65) Prior Publication Data

US 2010/0154271 A1 Jun. 24, 2010

Related U.S. Application Data

(63) Continuation of application No. 11/836,442, filed on Aug. 9, 2007, now Pat. No. 7,584,566.

(60) Provisional application No. 60/822,158, filed on Aug. 11, 2006.

(51) Int. Cl.
*F41A 17/00* (2006.01)

(52) U.S. Cl. ..... 42/70.07; 42/70.11; 70/58

(58) Field of Classification Search ..... 42/70.07, 42/70.11, 70.06; 211/64; 70/58, 158, 163, 70/166, 170, 77

See application file for complete search history.

(56) References Cited

U.S. PATENT DOCUMENTS

| | | | | |
|---|---|---|---|---|
| 3,624,945 | A | | 12/1971 | Foote |
| 3,637,180 | A | | 1/1972 | Parry |
| 3,664,163 | A | | 5/1972 | Foote |
| 4,855,713 | A | | 8/1989 | Brunius |
| 4,864,636 | A | | 9/1989 | Brunius |
| 5,022,534 | A | * | 6/1991 | Briggs ..... 211/4 |
| 5,196,827 | A | | 3/1993 | Allen et al. |
| 5,271,174 | A | | 12/1993 | Bentley |
| 5,283,971 | A | | 2/1994 | Fuller et al. |
| 5,309,661 | A | | 5/1994 | Fuller et al. |
| 5,392,551 | A | | 2/1995 | Simpson |
| 5,487,234 | A | * | 1/1996 | Dragon ..... 42/70.07 |
| 5,525,966 | A | | 6/1996 | Parish |
| 5,535,537 | A | | 7/1996 | Avganim |
| 5,561,935 | A | | 10/1996 | McCarthy et al. |

(Continued)

FOREIGN PATENT DOCUMENTS

DE 2614250 10/1977

(Continued)

OTHER PUBLICATIONS

"Recessed Micro Door/Window Sensor" Document No. 456-1502 Rev. C May 2000.*

(Continued)

*Primary Examiner* — Michael Carone
*Assistant Examiner* — Daniel Troy
(74) *Attorney, Agent, or Firm* — Dobrusin & Thennisch PC

(57) ABSTRACT

A securing system that includes a first wall portion adapted to be attached to a surface; and a second wall portion separable from the first wall portion and adapted to be removable engaged with the first wall portion; the second wall portion including an opening for receiving a projecting member from a male portion of a locking mechanism, wherein the second wall portion is disposed between the male portion and the female portion of the locking mechanism.

19 Claims, 5 Drawing Sheets

U.S. PATENT DOCUMENTS

| | | | | |
|---|---|---|---|---|
| 5,579,923 | A | 12/1996 | Hemmerlein | |
| 5,621,996 | A * | 4/1997 | Mowl, Jr. | 42/70.07 |
| 5,638,627 | A | 6/1997 | Klein et al. | |
| 5,720,193 | A | 2/1998 | Dick | |
| 5,761,206 | A | 6/1998 | Kackman | |
| 5,805,063 | A | 9/1998 | Kackman | |
| 5,809,013 | A | 9/1998 | Kackman | |
| 5,832,647 | A | 11/1998 | Ling et al. | |
| 5,887,730 | A * | 3/1999 | St. George | 211/4 |
| 5,899,102 | A | 5/1999 | Ling | |
| 5,918,402 | A | 7/1999 | Weinraub | |
| 5,942,981 | A | 8/1999 | Kackman | |
| 6,209,251 | B1 * | 4/2001 | Avganim | 42/70.07 |
| 6,260,300 | B1 | 7/2001 | Klebes et al. | |
| 6,269,575 | B1 | 8/2001 | Chang | |
| 6,308,540 | B1 * | 10/2001 | Lee | 70/58 |
| 6,330,815 | B1 | 12/2001 | Duncan | |
| 6,339,892 | B1 | 1/2002 | Ramos | |
| 6,389,726 | B1 * | 5/2002 | Bentley | 42/70.07 |
| 6,429,769 | B1 | 8/2002 | Fulgueira | |
| 6,474,238 | B1 | 11/2002 | Weinraub | |
| 6,578,393 | B2 | 6/2003 | Yarborought | |
| 6,601,332 | B1 | 8/2003 | Riebling | |
| 6,722,071 | B1 | 4/2004 | Lin | |
| 7,047,774 | B1 | 5/2006 | Gogel | |
| 7,116,224 | B2 | 10/2006 | Mickler | |
| 7,131,300 | B1 | 11/2006 | Monasco | |
| 7,281,397 | B2 | 10/2007 | Victor | |
| 7,367,150 | B2 | 5/2008 | Farchione et al. | |
| 7,584,566 | B2 * | 9/2009 | Victor et al. | 42/70.07 |
| 2002/0069569 | A1 | 6/2002 | Riebling et al. | |
| 2003/0213273 | A1 | 11/2003 | Vercoe | |
| 2004/0090153 | A1 * | 5/2004 | Touzani | 312/223.3 |
| 2005/0229654 | A1 * | 10/2005 | Victor | 70/58 |
| 2006/0112605 | A1 | 6/2006 | Sopko | |
| 2006/0117633 | A1 | 6/2006 | Chang | |
| 2007/0051026 | A1 | 3/2007 | Vor Keller | |

FOREIGN PATENT DOCUMENTS

| | | |
|---|---|---|
| DE | 29921048 | 4/2001 |

OTHER PUBLICATIONS

International Search Report dated May 6, 2005 PCT/US04/041862.

"Recessed Micro Door/Window Sensor" Document No. 466-1502 Rev. C ~ May 2000.

Master Lock ~ http://www.masterlock.com/cgi-bin/class_search.pl ~ Product No. 90,94.

Master Lock ~ http://www.masterlock.com/cgi-bin/class_search.pl ~ Product No. 106.

Co-pending Office Action mailed May 21, 2009, U.S. Appl. No. 11/860,781, filed Sep. 25, 2007.

Co-pending Office Action mailed, Nov. 24, 2010, U.S. Appl. No. 12/776,567.

Co-pending Office Action mailed, Apr. 26, 2011, U.S. Appl. No. 12/776,567.

* cited by examiner

SECURING SYSTEM WITH HOUSING FOR HARDWARE

CLAIM OF BENEFIT OF FILING DATE

The present application is a continuation of Ser. No. 11/836,442, filed on Aug. 9, 2007 now U.S. Pat. No. 7,584,566, which claims the benefit of the filing date of U.S. Application Ser. No. 60/822,158, filed Aug. 11, 2006, hereby incorporated by reference.

TECHNICAL FIELD

The present invention relates generally to a securing system, and in one particular aspect to a monitored securing system that includes a gun protection feature.

BACKGROUND

In recent years, there has been an increase in the number of jurisdictions that are requiring gun owners to securely stow their weapons when not in use. This has resulted in an increase in the number of locking mechanisms, particularly locks for preventing accidental discharge of weapons. Various commercially available examples of such locking mechanisms currently exist, with many of them functioning by the use of a locking cable, bar or other detent structure that, when attached to the gun, prevents the trigger from being squeezed.

In addition to the foregoing, there have been efforts by some to provide a securing system that includes a feature for particularly storing a weapon. Examples of such systems include those described in U.S. Pat. Nos. 5,196,827; 5,525,966, 5,487,234 and 6,429,769, hereby incorporated by reference.

Nothwithstanding the above efforts, there remains a need for a relatively simple, inexpensive, but effective approach to securing a gun or other device, such as a device that is trigger operated, and particularly an approach that can be readily assimilated into a securing system, such as a residential security system, a commercial security system, a mobile security system or otherwise.

SUMMARY OF THE INVENTION

The present invention meets the above needs by providing a securing system that includes a first wall portion adapted to be attached to a surface; and a second wall portion separable from the first wall portion and adapted to be removable engaged with the first wall portion; the second wall portion including an opening for receiving a Projecting member from a male portion of a locking mechanism, wherein the second wall portion is disposed between the male portion and the female portion of the locking mechanism.

DETAILED DESCRIPTION OF THE INVENTION

Figure 1:
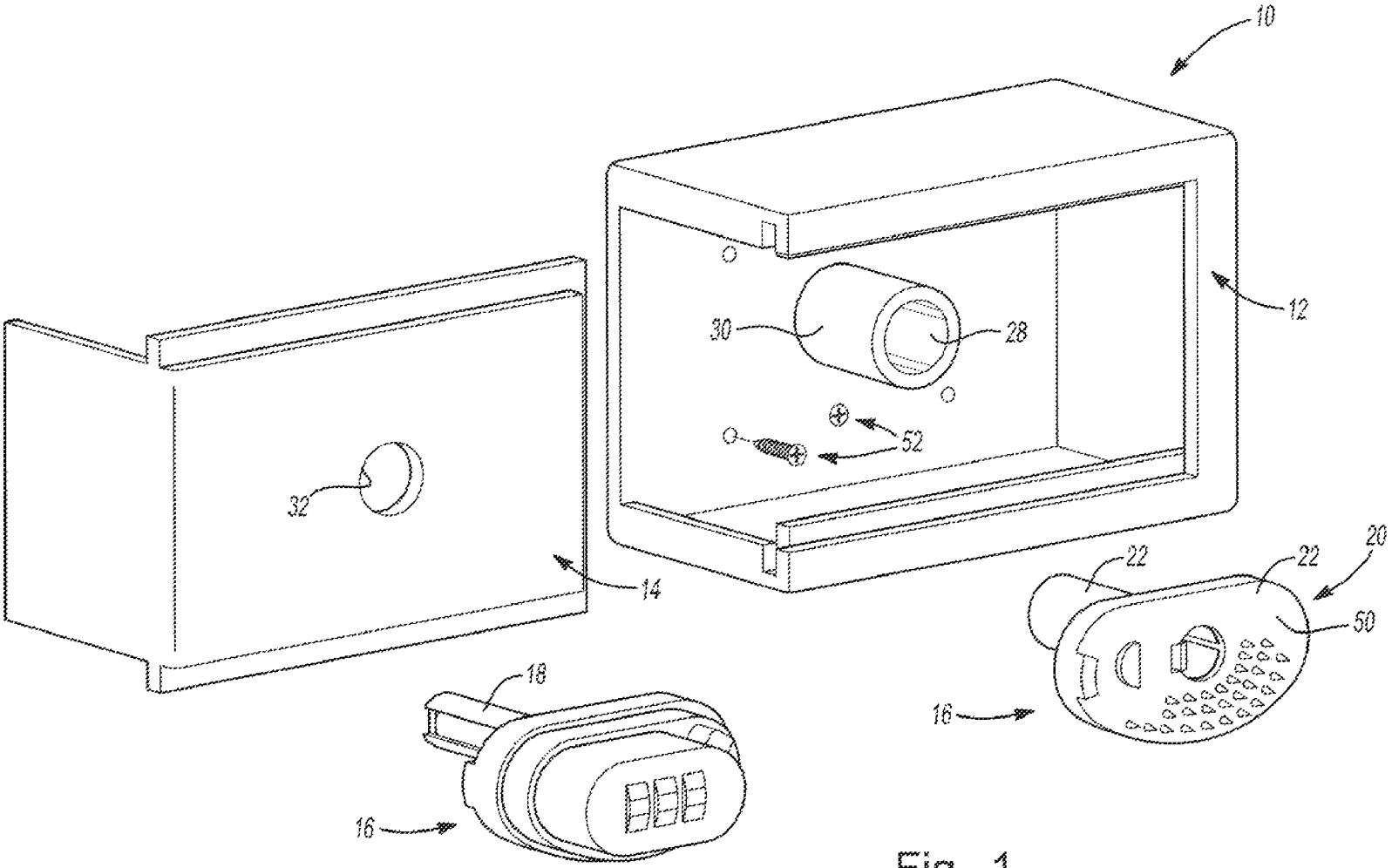
FIGS. 1-4 depict an illustrative example of a device in accordance with the present invention.

The present invention is directed to improvements in and to the subject matter of co-pending Published U.S. Patent application 2005/0229654, hereby incorporated by reference.

The present invention is directed to a structure adapted to be permanently or temporarily mounted to a surface (e.g., wall, a floor, a ceiling, a horizontal work surface, a door, a decorative trim panel, a piece of furniture, a storage container, a countertop, a drawer, a stud, a vehicle body in white, a vehicle trim, a vehicle frame, or any combination thereof) for receiving a firearm or other article that is secured with locking mechanism that includes at least two separable portions, each including a plate section. The structure generally comprises a first wall portion for mounting to a surface, and a second wall portion that is detachable from the first portion. The second wall portion includes an aperture through which a shank of the locking mechanism can pass, but which is dimensioned for preventing the plate sections of the separable portions from passing therethrough. The second wall portion is removably secured to the first wall portion in a suitable manner. For example, the respective wall portions may be fastened to each other, they may be interference fit relative to each other, they may be snap fit to each other, they may be friction fit relative to each other, they may be hinged to each other, they may be pivotally mounted relative to each other, or any combination thereof.

The first wall portion preferably includes one or more apertures for receiving a fastener to temporarily or permanently mount the first wall portion to a surface. Mounting may be done with a suitable adhesive as well. Other attachment approaches are possible including those disclosed in Published U.S. Patent application 2005/0229654. In general, it is contemplated that the mounting hardware will be concealed from view, and generally inaccessible in use.

The first wall portion may also include a structure adapted for receiving, in generally mating relationship, one of the separable portions of the locking mechanism. For example, a hollow post (which optionally may include a relatively high friction inner wall surface (e.g., from an elastomeric coating, liner or sleeve)) that is dimensioned to substantially correspond with an opposing structural member associated with the separable portion of the locking mechanism, may project from the wall portion.

The first or the second wall portion may include ornamentation as desired. In one aspect of the invention the second wall portion is adapted to be interchangeable with other second wall portions. Thus, a user has the option of changing the appearance of the assembly, or customizing the assembly. For example, the second wall portion may have a flat external surface, a contoured surface, or a combination of both. The second wall portion may include a regular geometric shape. It may include an arbitrary shape (e.g., a custom designed shaped, a logo, an initial, or otherwise). The second wall portion may be a metal, a plastic, a ceramic, or a combination thereof. It may include a plurality of layers (e.g., as a laminate). It may include a pattern or a weave. For example the second portion may include a fibre weave (e.g., from use of a carbon or plastic, such as an aramid fiber). The external finish may be dull, bright, reflective, transparent, opaque, smooth, textured or any combination thereof.

The present invention finds particular application for use with a gun lock of the type depicted in Published U.S. Patent application 2005/0229654, and U.S. Pat. Nos. 6,308,540 and 5,621,996. Examples of mechanisms that could be adapted for use in the present invention include, without limitation, those available from Pro-Lok® under the designation GUN-LOK™, those available from Master Lock, under one or more of the designations 940SPT (combination), 90KADSPT (key), 90(key), or the like. Other examples include those in U.S. Pat. Nos. 6,474,238, 5,918,402, 5,638,627, 5,487,234 or the like, all of which are hereby incorporated by reference.

The present invention advantageously contemplates retrofitting one or more components of the above types to form an assembly as described herein. However, independently fabricated structures may also be used.

With reference to the specific examples herein, as shown in FIGS. 1-4, there is seen one illustrative example of a securing structure 10 that includes a first wall portion 12 and a second wall portion 14. In the example shown, the second wall portion 14 is adapted for engagement (e.g., sliding engagement) with the first wall portion 12. A lock mechanism 16 is depicted as having a male portion 18 for matingly engaging a female portion 20 that include a hollow stem 22 for receiving the male portion. In the embodiment shown, an undercut groove 24 is defined in one of the first or the second wall portions for receiving a tongue 26 defined in the other of the first or the second wall portions. The securing structure 10 preferably also includes a recess defined therein for receiving the stem 22 of the female portion. For example, as shown, a recess 28 is defined in a post 30 formed in the first wall portion 12. The second wall portion 14 includes an opening 32. The locking mechanism shown in FIGS. 1-4 includes a combination device 34. Other suitable lock devices may be employed.

Figure 4:
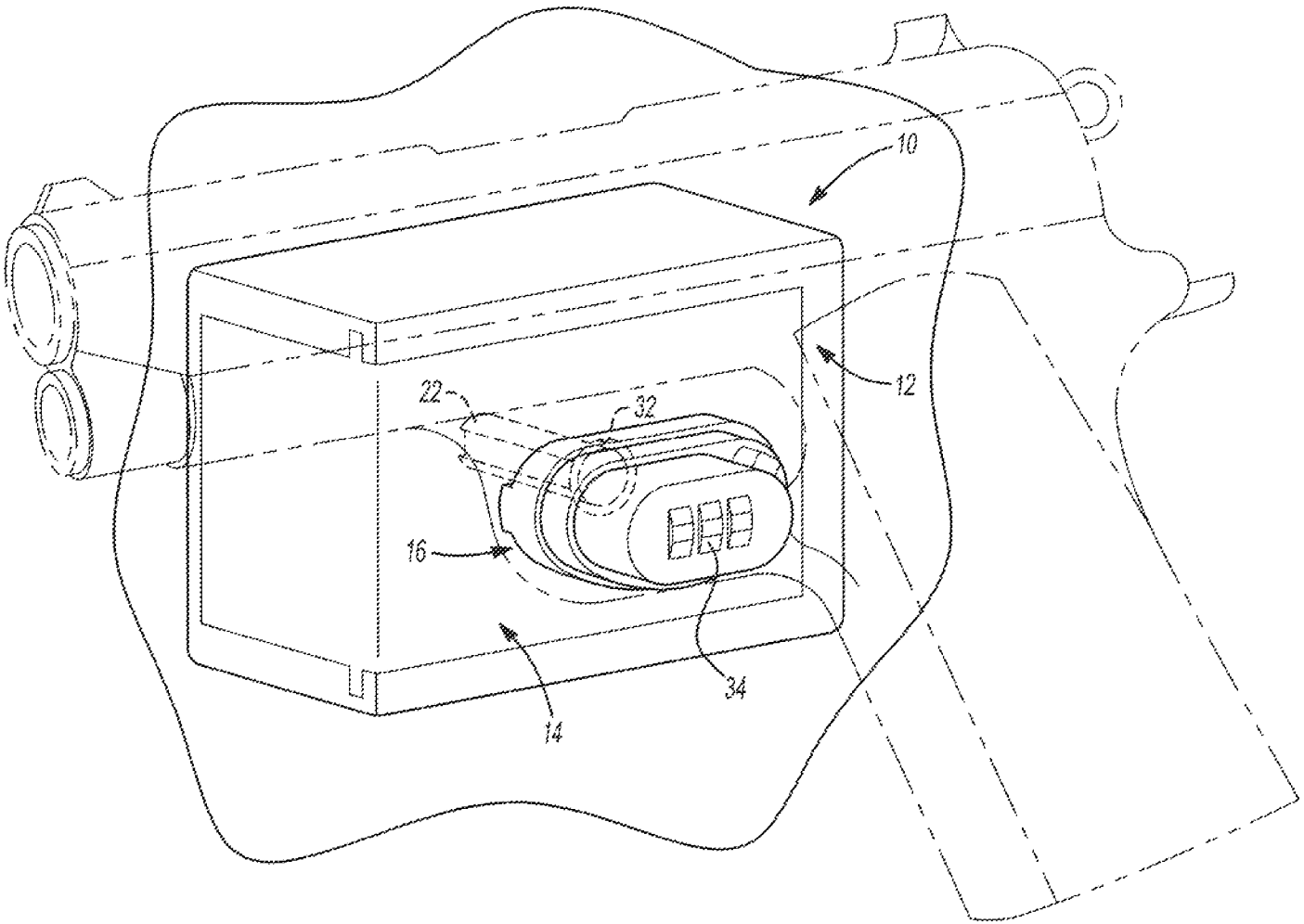

In use, the first wall portion 12 is mounted to a surface, such as by fasteners 52 through openings 36. The stem 22 of the female portion 20 of the locking mechanism is inserted into the recess 28. The second portion is placed over the female portion 20, so that the hollow stem 22 is substantially aligned with the opening 32. An article to be secured (e.g., a firearm) is placed between the second wall portion 14 and male portion 18 of the locking mechanism and the male and female portions of the locking mechanism are mated together in locking engagement. FIG. 4 illustrates the relationship, with the article to be secured in phantom.

Figure 5:
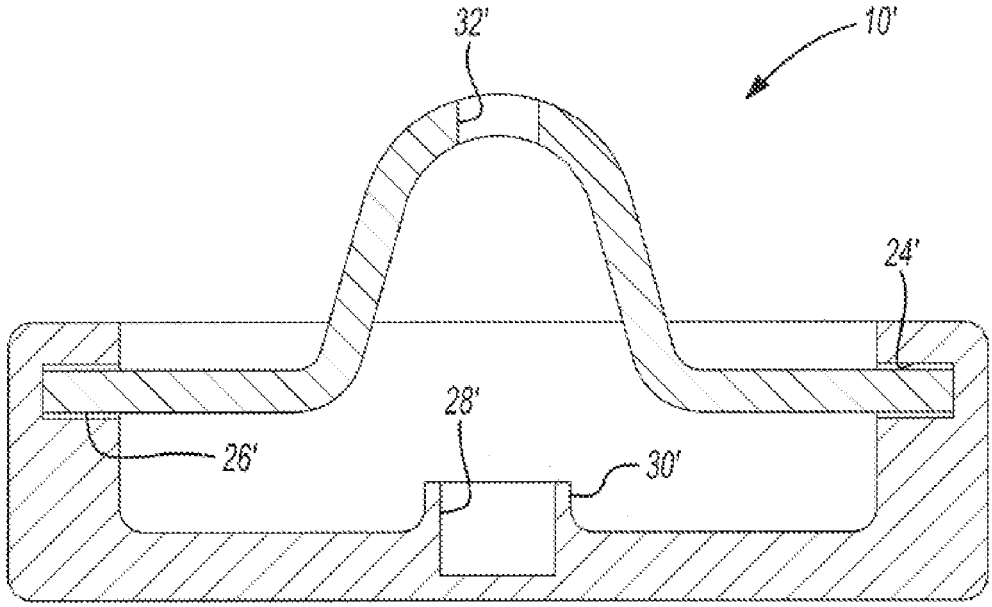
FIG. 5 illustrates an alternative structural configuration of a device in accordance with the present invention.

FIG. 5 illustrates a sectional view of another alternative to show a lower profile configuration. One benefit of the structure of FIG. 5 is that the second wall portion is that it can exhibit a constant profile along its length, thus rendering it suitable for manufacture by extrusion or pultrusion.

Figure 6:
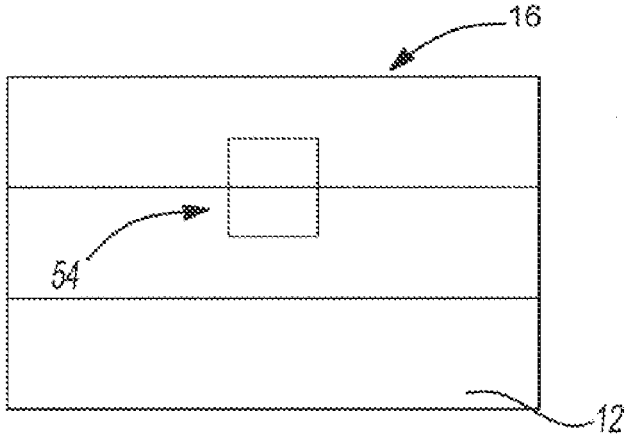
FIG. 6 illustrates one configuration including a sensor.

FIG. 6 illustrates a cross-section of a locking mechanism 16 that includes a two piece separable sensor 54. The locking mechanism 16 is illustrated mounted on the first wall portion 12.

It should be appreciated that the present invention finds particular suitability in connection with helping to secure firearm weapons against misuse. However, it also has broader application in connection with other systems where it is desired to help secure articles in a fixed location, and/or with respect to some articles, to help prevent trigger actuation of a device, including trigger actuated hand tools or power tools such as saws, drills, mills, nail guns, staple guns, or the like, kitchen utensils, pesticide dispensers, paint or other surface coating sprayers, powered surgical instruments, other fluid dispensers, or the like. Other household, commercial or industrial articles requiring securing (e.g., cutting implements, narcotics, alcoholic beverages, cash, negotiable instruments, securities or otherwise) may also be secured using the present invention, and such articles need not be trigger operated. Further, it should be appreciated that even though the invention is illustrated with particular reference to a residential, commercial or mobile securing system, it is suitable for many other applications. In addition, though in some embodiments the present invention contemplates the installation of complete securing systems that incorporate components of the present invention, it is contemplated that certain existing systems may be retrofitted with a device of the present invention, and such retrofitting is contemplated as within the present invention.

The present invention may also be adapted for enabling the use of an optional sensing portion (e.g., a two-piece separable sensor that communicates a signal when separated), such as may be part of an alarm system, in accordance with the teachings of Published U.S. Patent application 2005/0229654, incorporated by reference.

It should be realized that as shown in the drawings herein, the relative positioning of the male and female components may be interchanged. Either one of the male or the female components may be integrally formed with the first or the second wall portions. Further, though a number of embodiments herein illustrate a projection of the male component generally perpendicular relative to the mount portion, other orientations are also possible, including at an angle greater than or less than 90 degrees, or generally parallel relative to the mount portion.

Figure 2:
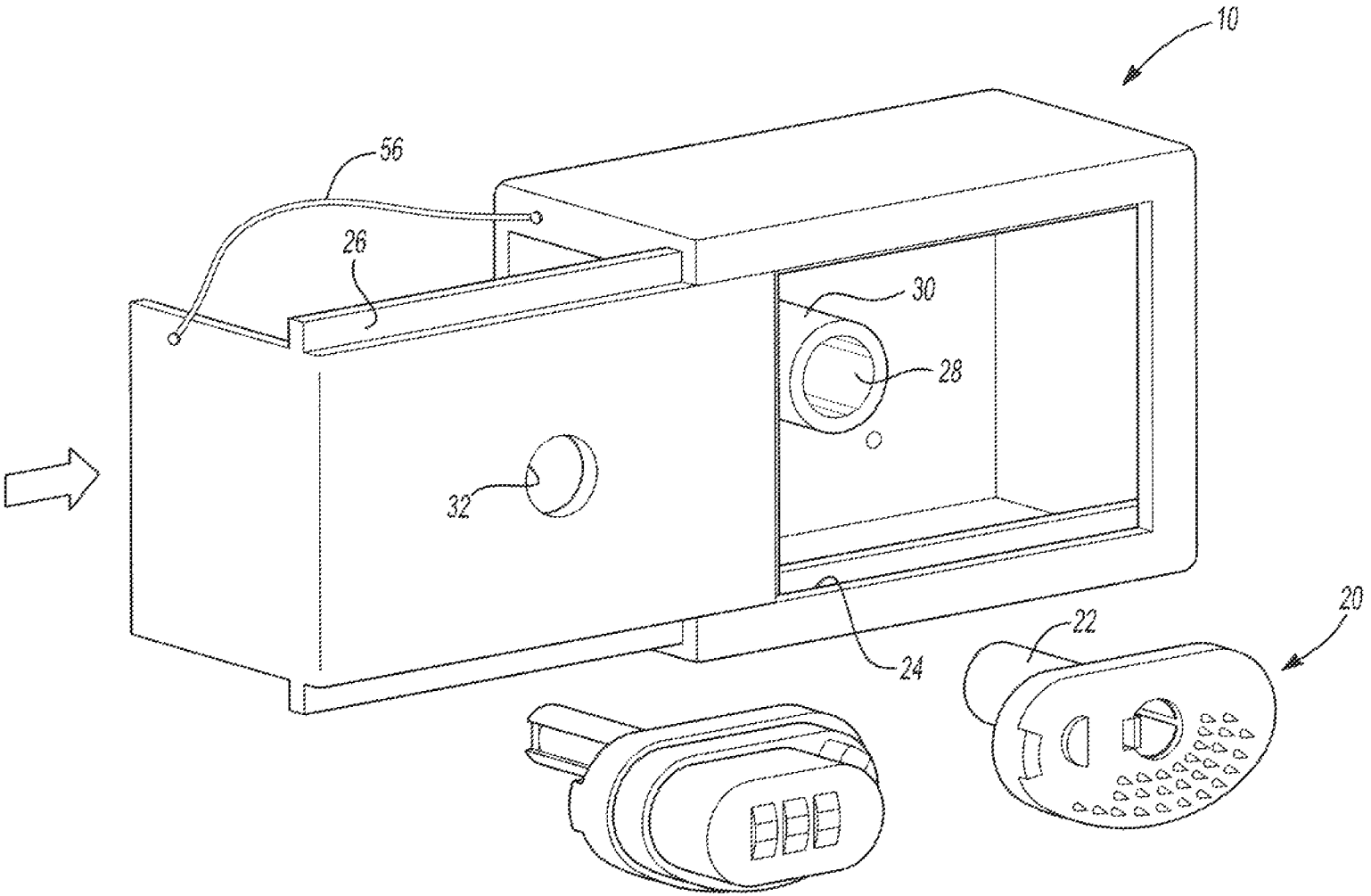
Figure 3:
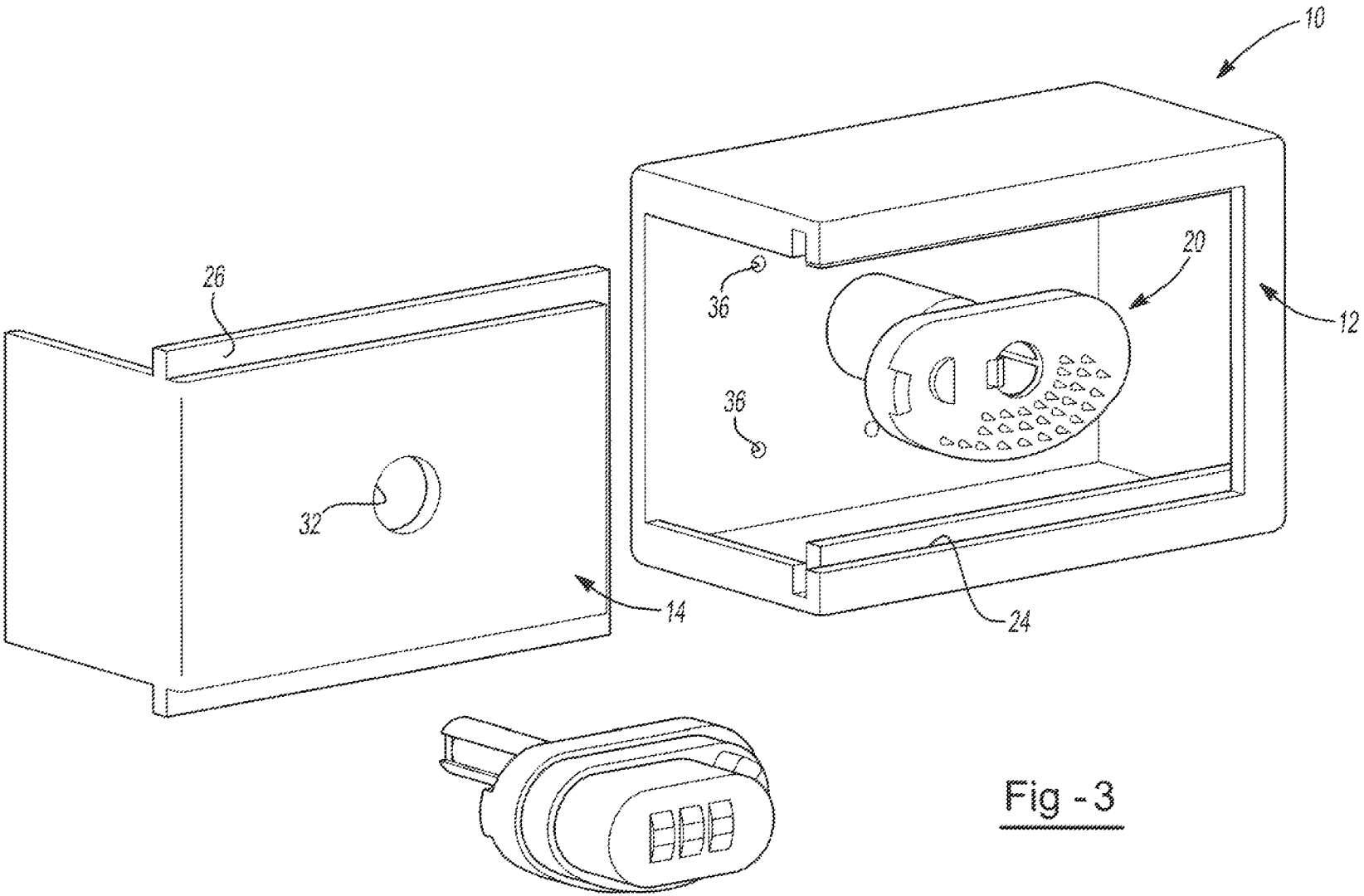

The separable portions (of the wall portions, the locking portions or both) need not be entirely separable from each other, and thus could include two or more portions that are hinged, tethered 56 as illustrated in FIG. 2, or otherwise connected relative to each other.

Another possible approach is to employ a hinge structure that allows for both pivotal movement of a portion and sliding motion.

One or more portions that are to come into contact with a trigger operated device will include a relatively soft resilient surface to avoid marring or scratching of the triggered device. One embodiment contemplated the use of one or more pads 50, made of a relatively soft material, such as a plastic (e.g., a polyolefin, a fluorinated polymer (e.g., PTFE), or another plastic), a natural rubber, a synthetic rubber, woven cloth, unwoven cloth, felt, combinations thereof, or the like.

The first wall portion and the second wall portion may be fabricated from the same processing technique (e.g. stamped, cast, injection molded, blow molded, rotational molded, thermoformed, compression molded, or otherwise). In one aspect, they are fabricated from dissimilar techniques. For example, one of the portions is roll formed, extruded or pultruded for defining a predetermined substantially constant profile, and the other portion is stamped, cast, injection molded, blow molded, rotational molded, thermoformed, compression molded, or otherwise fabricated.

In general, the separable portions of the locking mechanism will cooperate for securing an article to be secured therebetween, such as a firearm. Any suitable locking mechanism may be employed for releasably attaching the separable portions, ranging from a keyed lock, a combination lock, an electronically controlled lock, an actuatable member (e.g., a latch, a deadbolt, a cam lock, a hook, or the like) such as a solenoid driven member, which is manually actuated or actuated in response to a signal from a touch screen, a key pad, identification badge (including for example cards and tags as well), bar code, visual scan, active or passive radiofrequency identification device (RFID), a biometric scan (e.g., an eye, face, finger, hand or DNA scan) or the like, or some other suitable mechanism.

Any of the portions can integrally be assembled into one piece and need not be separated or relocated to another portion.

Reference to "gun holder portion" or other "gun"—specific references are not intended as limiting the invention solely to the use of guns. As discussed, other devices, and particularly trigger actuated devices can be secured using the present invention, with the "gun holder portion" or other "gun"—specific component being adapted for the particular device desired to be secured. Further use of "wireless" refers to the absence of wires as the primary signaling link between devices, and does not preclude the existence of wires contained within a device. Without limitation, wireless devices may upon a form of optical, thermal or other detectable electromagnetic signal to achieve signaling communication. References to "first" or "second" are not intended to exclude the presence of additional components. Nor are they intended necessarily to denote a particular sequence.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A trigger operated article securing device comprising:
a locking mechanism including:
a male portion including:
a projecting member and
a lock device,
a female member into which the projecting member is inserted, and
one or more pads;
a securing structure including:
a first wall portion that attaches to a surface, the first wall portion including:
a post, the post including a recess; and
a second wall portion separable from the first wall portion and adapted to be slidingly engaged with the first wall portion in a tongue and groove configuration; the second wall portion including an opening for receiving the projecting member of the male portion of the locking mechanism, wherein the second wall portion is disposed between the male portion and a female portion of the locking mechanism;
wherein a trigger operated article is lockingly secured by blocking depression of a trigger of the trigger operated article with the projecting member while the trigger operated article is positioned between the second wall portion and one of the male portion or female portion of the locking mechanism and wherein the post including the recess receives, in a generally mating relationship, one of the male portion or the female portion of the locking mechanism.

2. The securing device according to claim 1, wherein the second wall portion is contoured.

3. The securing device according to claim 1, wherein the first wall portion is attached to a surface with fasteners that are concealed by the first wall portion, the second wall portion, or both when the first and second wall portions are engaged with each other.

4. The securing device according to claim 3, wherein the surface is selected from one or more of a wall, a floor, a ceiling, a horizontal work surface, a door, a decorative trim panel, a piece of furniture, a storage container, a countertop, a drawer, a stud, a vehicle body in white, a vehicle trim, a vehicle frame, or any combination thereof.

5. The securing device according to claim 4, wherein upon assembly, one of the male portion or the female portion of the locking mechanism is concealed from view.

6. The securing device according to claim 5, wherein the first wall portion and the second portion include a flush fit outer surface at a joint between the two.

7. The securing device according to claim 6, wherein the outer surface is substantially planar at the joint between the first wall portion and the second wall portion.

8. The securing device according to claim 6, wherein the device includes a two piece separable sensor that communicates a signal when separated.

9. The securing device according to claim 1, wherein the device includes a two piece separable sensor that communicates a signal when separated.

10. The securing device according to claim 1, wherein the first wall and the second wall include a tether so that the first wall and the second wall are connected relative to each other.

11. The securing device according to claim 1, wherein the lock device is a keyed lock, a combination lock, an electronically controlled lock, an actuatable member, a touch screen, a key pad, a bar code, a visual scan, active or passive radiofrequency identification device, a biometric scan, or a combination thereof.

12. The securing device according to claim 1, wherein upon assembly, the female portion of the locking mechanism is enclosed and concealed from view by the securing structure.

13. The securing device according to claim 12, wherein the female portion includes a hollow stem and the hollow stem is inserted into the recess of the post so that the hollow stem of the female portion is aligned with an opening in the second wall portion when the second wall portion is placed in the first wall portion,
wherein the projection of the male portion passes through the trigger operated article and the opening in the second wall portion into the hollow stem of the female portion locking the trigger operated article so that the female portion of the locking mechanism is enclosed and concealed from view by the securing structure.

14. The securing device according to claim 1, wherein the female portion includes a stem.

15. The securing device according to claim 1, wherein the female portion includes a stem and the stem is inserted into the recess of the post so that the stem of the female portion is aligned with an opening in the second wall portion.

16. The securing device according to claim 15, wherein the device includes a two piece separable sensor that communicates a signal when separated.

17. The securing device according to claim 16, wherein the first wall and the second wall include a tether so that the first wall and the second wall are connected relative to each other.

18. The securing device according to claim 1, wherein the trigger operated article is a firearm.

19. The securing device according to claim 1, wherein the trigger operated article includes saws, drills, mills, nail guns, staple guns, kitchen utensils, pesticide dispensers, paint or other surface coating sprayers, powered surgical instruments, other fluid dispensers, or a combination thereof.

* * * * *